US006218619B1

(12) United States Patent
Asakura et al.

(10) Patent No.: US 6,218,619 B1
(45) Date of Patent: Apr. 17, 2001

(54) CONNECTING STRUCTURE FOR SHIELDED WIRE AND PROCESSING METHOD THEREFOR

(75) Inventors: Nobuyuki Asakura; Tetsuro Ide; Yasumichi Kuwayama, all of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/141,513

(22) Filed: Aug. 27, 1998

(30) Foreign Application Priority Data

Aug. 29, 1997 (JP) ..... 9-234820
Oct. 24, 1997 (JP) ..... 9-292683

(51) Int. Cl.[7] ..... H01R 13/648
(52) U.S. Cl. ..... 174/78
(58) Field of Search ..... 174/84 R, 78, 174/74 R, 94 R, 75 C; 439/98, 99, 610, 578, 874

(56) References Cited

U.S. PATENT DOCUMENTS 807,747 * 12/1905 Kling ..... 174/92
3,315,024 * 4/1967 Ball ..... 174/78
3,643,008 * 2/1972 Brazee ..... 174/78 X
3,897,127 * 7/1975 Haitmanek ..... 439/98
5,163,856 11/1992 McGaffigan et al. ..... 439/874
5,315,063 * 5/1994 Auclair ..... 174/78
5,418,330 * 5/1995 Rook ..... 174/78
5,584,122 * 12/1996 Kato et al. ..... 174/84 R X
5,869,784 * 2/1999 Shinchi ..... 174/84 R X
5,922,993 * 7/1999 Ide et al. ..... 174/84 R
5,925,202 * 7/1999 Ide et al. ..... 174/84 R X
5,959,252 * 9/1999 Ide et al. ..... 174/84 R X

FOREIGN PATENT DOCUMENTS 2 211 367 6/1989 (GB) .
2 232 013 11/1990 (GB) .
7-201383 8/1995 (JP) .
8-78071 3/1996 (JP) .

* cited by examiner

*Primary Examiner*—Kristine Kincaid
*Assistant Examiner*—Chau N. Nguyen
(74) *Attorney, Agent, or Firm*—Finnegan, Henderson, Farabow, Garrett & Dunner, L.L.P.

(57) ABSTRACT

A connecting structure for a shielded wire, including a shielded wire having a core made of a conductor, a core cover for covering the core, a braid provided around the core cover for shielding, and an insulating outer cover provided around the braid for covering the core, core cover and braid; and a shield terminal having a lead wire attached at an end to a terminal metal and conductively connected at a portion between the attached end and an unattached end to the braid of the shielded wire. This structure is formed by placing the portion of the lead wire of the shield terminal on the insulating outer cover of the shielded wire, placing a resin chip on the portion of the lead wire of the shield terminal, and applying an ultrasonic vibration so as to melt and disperse the insulating outer covers of the shielded wire and the lead wire, thereby forming a shielded conductive portion in which the shield terminal and braid are conductively in contact with each other.

16 Claims, 14 Drawing Sheets

CONNECTING STRUCTURE FOR SHIELDED WIRE AND PROCESSING METHOD THEREFOR

BACKGROUND OF THE INVENTION

1. Field of the Invention

This invention relates to a connecting structure and a processing method for a shielded wire in which a shield terminal is connected to braid at an end portion of the shielded wire.

2. Description of Relevant Art

FIGS. 1A, 1B show a conventional processing method of a shielded wire end disclosed in Japanese Patent Application Laid-Open Publication No. 7-201383. Under this structure, an end portion of a shielded wire 1 is separated to core 2 and braid 3 and a terminal metal (a terminal metal to be connected to an end of the braid 3 is referred to as "shield terminal") 4 is crimped to each of ends of the core 2 and braid 3. Before the terminal metal is crimped to the shield terminal 4, the end portion of the braid 3 is bound by a heat shrinkage tube 5.

However, in the connecting structure described in the aforementioned patent application, in addition to a procedure for peeling the core cover covering the core 2 so as to expose the core 2, a procedure for peeling a long portion of a insulating outer cover 6 covering the braid 3 to expose the braid 3, a procedure for twisting the braid 3 to fit the heat shrinkage tube 5 to the exposed braid 3, and a procedure for passing the twisted braid 3 through the heat shrinkage tube 5 are needed, so that it takes a long time for this connection work. Further, because it is so constructed that the braid 3 does not cover the core cover in a long range, the shielding performance drops.

Therefore, Japanese Patent Application Laid-Open Publication No. 8-78071 has disclosed a structure which enables the braid 7 connect to to the shield terminal 8 easily. Under this structure, as shown in FIGS. 2, 3, the covering of the shielded wire 9 is peeled before connection. After the braid 7 is exposed by peeling the insulating outer cover 10, the braid 7 is folded back toward the insulating outer cover 10 so that it overlaps. After that, an insulating inner cover 11 is peeled so as to expose a core 12.

This processed shielded wire 9 is fixed to a terminal 13 via the insulating inner cover 11 by inserting the insulating inner cover 11 into a holding portion 13*a* of the terminal 13 and then crimping the holding portion 13*a*. Further by crimping a connecting portion of the terminal 13, the core 12 is connected to the terminal 13. Then, with this condition, the terminal 13, is inserted into the cylindrical shield terminal 8 and the braid 7 is connected inside the shield terminal 8.

The connection between the shield terminal 8 and braid 7 is carried out by making leaf springs 14, 14 which are folded inside the shield terminal 8 as shown in FIG. 3, into contact with the braid 7 so as to ensure conductivity. In FIGS. 2, 3, reference numeral 15 denotes a housing in which the shield terminal 8 and terminal 13 are inserted, and reference numeral 16 denotes a cap to be fit to an opening end 8*a* of the shield terminal 8.

Under this connecting structure, it is not necessary to expose the braid 7 in a long range and the procedures for twisting the braid 7, inserting the braid 7 into the heat shrinkage tube, and crimping the shield terminal 8 to the braid 7 are eliminated. Therefore, its work efficiency for the connection has been improved as compared to the connecting structure described first.

However, in this connecting structure, the procedure for exposing the braid 7 by peeling the insulating outer cover 10 of the shielded wire 9 is necessary. This peeling procedure is troublesome and time-consuming.

Further, it is necessary to provide leaf springs 14 inside the shield terminal 8 specially designed for the shielded wire 9 and further the housing 15 for accommodating the shield terminal 8 must be specially designed for the shielded wire 9 and the cap 16. As a result, the entire structure becomes complicated and a large number of parts are required, so that production cost is high.

Further, to avoid a poor contact between the leaf spring 14 and braid 7, a spring load of the leaf spring 14 needs to be set large. However, if the spring load is set larger than required, it becomes difficult to insert the braid 7 in between the leaf springs 14. Further, if the spring load is large, the braid 7 is drawn by the leaf springs 14 so that a poor contact between the leaf springs 14 and braid 7 may occur.

SUMMARY OF THE INVENTION

The present invention has been achieved with such points in view.

It therefore is an object of the present invention to provide a connecting structure for a shielded wire having a simple structure, which does not require a troublesome peeling procedure and is capable of achieving a quick connecting processing and a processing method therefor.

To achieve the above object, according to a first aspect of the invention, there is provided a connecting structure for a shielded wire, comprising a core made of conductor, a core cover for covering the core, a braid provided around the core cover for shielding and an insulating outer cover provided around the braid for covering the core, core cover and braid, for connecting a shield terminal to the braid. The shield terminal in the present invention includes a lead wire attached at one end to a terminal metal and conductively connected at the braid at a portion between the attached and the unattached end. An ultrasonic vibration is applied in a condition that an end of the shield terminal is placed on the insulating outer cover and a resin chip is placed on an end of the shield terminal, so as to melt and disperse the insulating outer cover thereby bringing the end of the shield terminal and braid conductively in contact with each other.

According to this connecting structure of the shielded wire, an end of the shield terminal is placed on the insulating outer cover in a condition that the insulating outer cover at an end portion is not peeled or the braid is not exposed, and the resin chip is placed on the end of the shield terminal. By applying ultrasonic vibration to the resin chip, at least the insulating outer cover of resin is melted and dispersed, so that a shielded conductive portion in which the braid and the end of the shield terminal are conductively in contact with each other is formed.

In this connecting structure, the procedure for peeling the insulating outer cover so as to expose the braid is not necessary. Instead, by placing an end of the shield terminal on the insulating outer cover, placing the resin chip on the end of the shield terminal and applying ultrasonic vibration, the braid and shield terminal can be connected to each other easily. That is, the connecting processing can be carried out quickly.

Further, the housing, cap and the like for accommodating the shield terminal are not necessary, so that a simple connecting structure is ensured.

According to a second aspect of the present invention, there is provided a connecting structure for a shielded wire wherein an end of the lead wire is connected to an end of the terminal metal by applying an ultrasonic vibration in a condition that the end of the lead wire is placed on the insulating outer cover and the resin chip is placed on the portion of the terminal metal on which the lead wire is placed.

According to this connecting structure for the shielded wire, the unattached end of the lead wire is placed on the insulating outer cover of the shielded wire in a condition that the insulating outer cover of the lead wire at the end portion is not peeled or the braid is not exposed, and then the resin chip is placed on the unattached end. If ultrasonic vibration is applied to the resin chip in this condition, at least the insulating outer cover of resin of the shielded wire is melted and dispersed. If the lead wire is a covered wire, the covered portion of this lead wire is also melted and dispersed. As a result, the braid is conductively in contact with the unattached end of the lead wire and the braid is conductively in contact with the terminal metal through the lead wire.

According to a third aspect of the present invention, there is provided a connecting structure for a shielded wire wherein the lead wire is constituted of a covered wire in which the periphery of a conductor is covered with an insulator made of resin and by application of ultrasonic vibration, the insulator is melted and dispersed together with the insulating outer cover thereby bringing the conductor of the lead wire and the braid being conductively in contact with each other.

According to this connecting structure for the shielded wire, the lead wire is laced on the insulating outer cover of the shielded wire, the resin chip is placed on the lead wire and ultrasonic vibration is applied. As a result, the insulating outer cover of the shielded wire and the insulating cover of the lead wire are melted and dispersed, so that the braid and conductor of the lead wire are conductively in contact with each other.

According to a fourth aspect of the present invention, there is provided a connecting structure for a shielded wire wherein the lead wire is placed on the insulating outer cover of the shielded wire in a condition that the lead wire crosses the shielded wire, the resin chip is laced on the lead wire, and ultrasonic vibration is applied.

By applying ultrasonic vibration in a condition that the lead wire and shielded wire are placed to cross each other, the insulating cover of the lead wire and insulating outer cover of the shielded wire are melted and dispersed. As a result, the conductor of the lead wire is conductively in contact with the braid of the shielded wire. At this time, the inside conductor becomes loose because the lead wire crosses the shielded wire and individual conductor pieces come into contact with the braid. Therefore, the contact of the conductor with the braid increases thereby, providing a stabilized conductive state.

Further, because melted resin of the chip invades in between the individual conductor pieces, the adhesive force between the conductor and resin chip is intensified. Therefore, the lead wire and shielded wire are firmly coupled with each other.

According to a fifth aspect of the present invention, there is provided a connecting structure for a shielded wire wherein the lead wire is placed on the insulating outer cover in a condition that the lead wire crosses the shielded wire at 45°–135°, the resin chip is placed on the lead wire and ultrasonic vibration is applied.

Because the conductor of the lead wire becomes loose securely when the crossing angle between the lead wire and shielded wire is in a range of 45°–135°, electric connection with the braid is stabilized. Further because the melted resin of the chip invades in between the individual conductor pieces, the bonding is firm.

According to a sixth aspect of the present invention, there is provided a connecting structure for a shielded wire wherein a concave portion which is arcuate along an outer shape of the shielded wire is formed on a mounting face of the resin chip to the insulating outer cover.

With this connecting structure for a shielded wire, because the arcuate concave portion is formed in the resin chip, an ultrasonic vibration is applied equally to the insulating outer cover of the shielded wire so that the insulating outer cover can be melted and dispersed excellently. Therefore, the tearing and cutting of the shielded wire are prevented and the fitting force is remarkably improved.

According to a seventh aspect of the present invention, there is provided a connecting structure for a shielded wire wherein grooves cross each other at a crossing angle. The lead wire and the shielded wire are to be inserted in the grooves, which are formed in a mounting face of the resin chip relative to the insulating outer cover.

Because the grooves hold this crossing state if the lead wire and shielded wire are inserted therein, the crossing between the lead wire and shielded wire is stabilized. Only if the lead wire and shielded wire are inserted into the crossing grooves, can they be placed to cross each other easily. Thus, working efficiency is improved. Further, because ultrasonic vibration is applied in such a stabilized crossing state, the conductor of the lead wire becomes loose yet secure.

According to an eighth aspect of the present invention, there is provided a connecting structure for a shielded wire wherein the grooves cross each other at a crossing angle of 45°–135°.

By forming the crossing grooves so that they cross each other at 45°–135°, the lead wire and shielded wire can be placed to cross each other stably.

According to a ninth aspect of the present invention, there is provided a connecting structure for a shielded wire wherein an end of a shield terminal and the shielded wire are nipped between the resin chips and ultrasonic vibration is applied so as to melt and disperse at least the insulating outer cover. Thereby the resin chips are fused with each other.

With this connecting structure for a shielded wire, the end of the shield terminal and the shielded wire are nipped between the two resin chips and ultrasonic vibration is applied. As a result, at least the insulating outer cover of the shielded wire is melted and dispersed. At the same time, the resin chips are fused with each other by ultrasonic vibration. Therefore, the shielded wire is nipped by the resin chips in a condition that the end of the shield terminal is conductively in contact with the braid.

According to a tenth aspect of the present invention, there is provided a processing method for conductively connecting a shielded wire comprising a core made of a conductor, a core cover for covering the core, a braid provided around the core cover for shielding and an insulating outer cover provided around the braid for covering the core, core cover and braid, wherein ultrasonic vibration is applied in a condition that an end of the shield terminal is placed on the insulating outer cover of the shielded wire and a resin chip is placed on this end of the shield terminal, so as to melt and disperse the insulating outer cover, bringing the end of the shield terminal and braid conductively in contact with each other.

According to this processing method for the shielded wire, one end of the shield terminal is placed on the insulating outer cover of the shielded wire and the resin chip is placed on this end of the shield terminal. By applying ultrasonic vibration under this condition, the insulating outer cover is melted and dispersed. As a result, the braid is conductively in contact with the one end of the shield terminal.

According to an eleventh aspect of the present invention, there is provided a processing method for a shielded wire, comprising a core made of a conductor, a core cover for covering the core, a braid provided around the core cover for shielding, and an insulating outer cover provided around the braid for covering the core, core cover and braid, wherein an end of a shield terminal and a shielded wire are nipped between two resin chips and ultrasonic vibration is applied so as to melt and disperse at least the insulating outer cover bringing the end of the shielded terminal and the braid conductively in contact with each other.

According to this processing method for the shielded wire, the one end of the shield terminal and shielded wire are nipped between the two resin chips and ultrasonic vibration is applied so as to melt and disperse at least the insulating outer cover. If the insulating outer cover is melted and dispersed, this end of the shield terminal is conductively in contact with the braid. At the same time, the resin chips are fused with each other. Thus, the shielded wire is nipped between the resin chips.

According to a twelfth aspect of the present invention, there is provided a processing method for a shielded wire, comprising a core made of a conductor, a core cover for covering the core, a braid provided around the core cover for shielding, and an insulating outer cover provided around the braid for covering the core, core cover and braid, wherein an end of a lead wire is connected to an end of the shield terminal, the lead wire is placed on the insulating outer cover in a condition that the lead wire crosses the shielded wire, the crossing portion of the lead wire and shielded wire are nipped between two resin chips and ultrasonic vibration is applied so as to melt and disperse at least the insulating outer cover. The lead wire and shielded wire therefore are conductively connected to each other.

According to this processing method, because ultrasonic vibration is applied in a condition that the lead wire and shield wire are placed to cross each other, the conductor inside the lead wire becomes loose so that contacts between the lead wire and braid of the shielded wire increase. Further, because the two resin chips fused by ultrasonic vibration nip and fix the conductor and braid in the contacting condition, a stabilized fixing can be carried out.

According to a thirteenth aspect of the present invention, there is provided a processing method for a shielded wire wherein the lead wire and the shielded wire are placed to cross each other at a crossing angle of 45°–135°.

Because the lead wire and shielded wire are placed to cross each other in a range of 45°–135°, the conductor of the lead wire becomes loose yet secure.

According to a fourteenth aspect of the present invention, there is provided a processing method for a shielded wire wherein an end of the lead wire in which the periphery of a conductor is covered with an insulator made of resin is connected to an end of the terminal metal, the other end thereof is placed on the insulating outer cover and ultrasonic vibration is applied so as to melt and disperse the insulator together with the insulating outer cover.

According to this processing method for the shielded wire, the unattached end of the lead wire is placed on the insulating outer cover of the shielded wire and the resin chip is placed thereon. By applying ultrasonic vibration with this condition, the insulating cover is melted and dispersed. As a result, the braid is conductively in contact with the conductor and the braid is connected to the terminal metal via the lead wire.

BRIEF DESCRIPTION OF THE ACCOMPANYING DRAWINGS

The above and further objects and novel features of the present invention will more fully appear frog the following detailed description when the same is read in conjunction with the accompanying drawings, in which:

FIGS. 1A and 1B show a conventional connecting structure for a shielded wire, wherein FIG. 1A is a perspective view showing a state prior to inserting a braid through a sleeve, and FIG. 1B is a perspective view showing a state in which the braid has been inserted through the sleeve;

FIGS. 4A and 4B show a relation between a shielded wire and shield terminal according to a first embodiment, wherein FIG. 4A is a disassembly perspective view showing a state before the shielded wire is connected to the shield terminal, and FIG. 4B is a perspective view showing a state in which the shielded wire is connected to the shield terminal;

FIGS. 5A and 5B show a shielded wire, wherein FIG. 5A is a plan view showing a state in which the insulating outer cover is peeled so as to expose the braid, and FIG. 5B is a plan view showing a state in which only the core is exposed while the braid is not exposed;

FIGS. 16A and 16B show an operation of the third embodiment, wherein FIG. 16A is a sectional view taken along the lines A—A of FIG. 11, and FIG. 16B is a sectional view taken along the lines B—B;

FIGS. 21A and 21B are diagrams for explaining an inconvenience of the precedent structure of the third embodiment, wherein FIG. 21A is a sectional view taken along the lines C—C in FIG. 19, and FIG. 21B is an enlarged sectional view.

DETAILED DESCRIPTION OF THE PREFERRED EMBODIMENTS

Figure 1A:
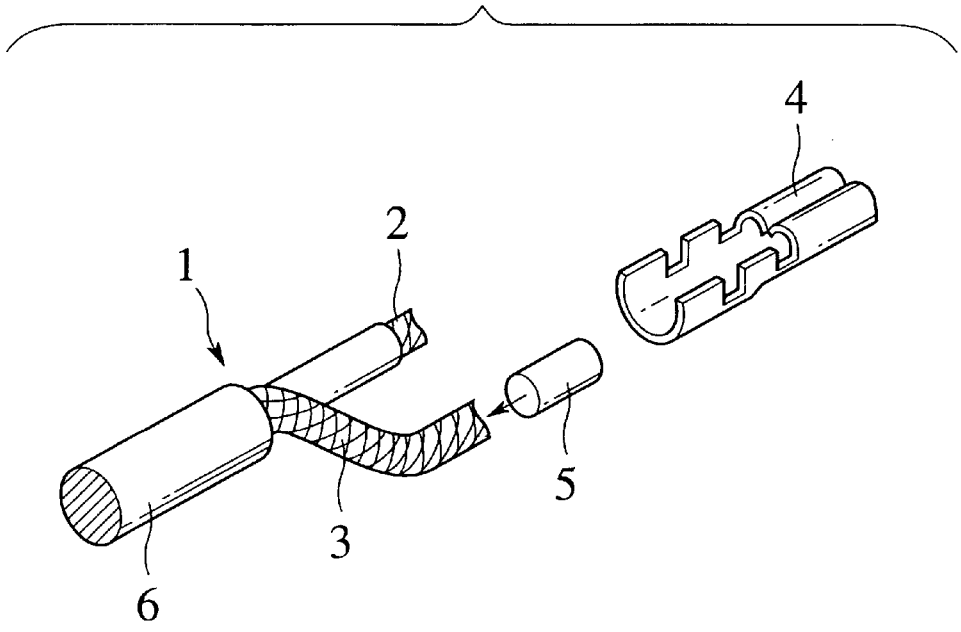
FIG.1A PRIOR ART
Figure 1B:
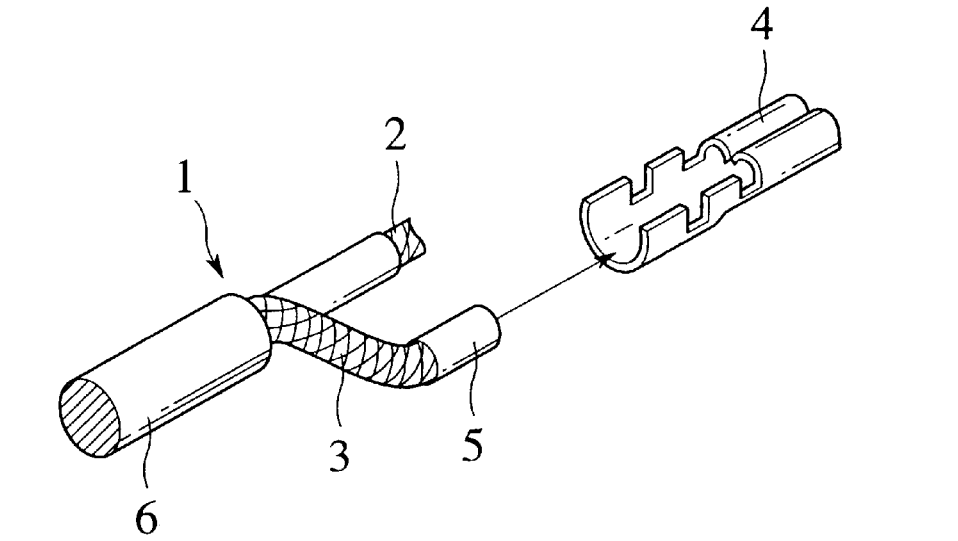
FIG.1B PRIOR ART
Figure 2:
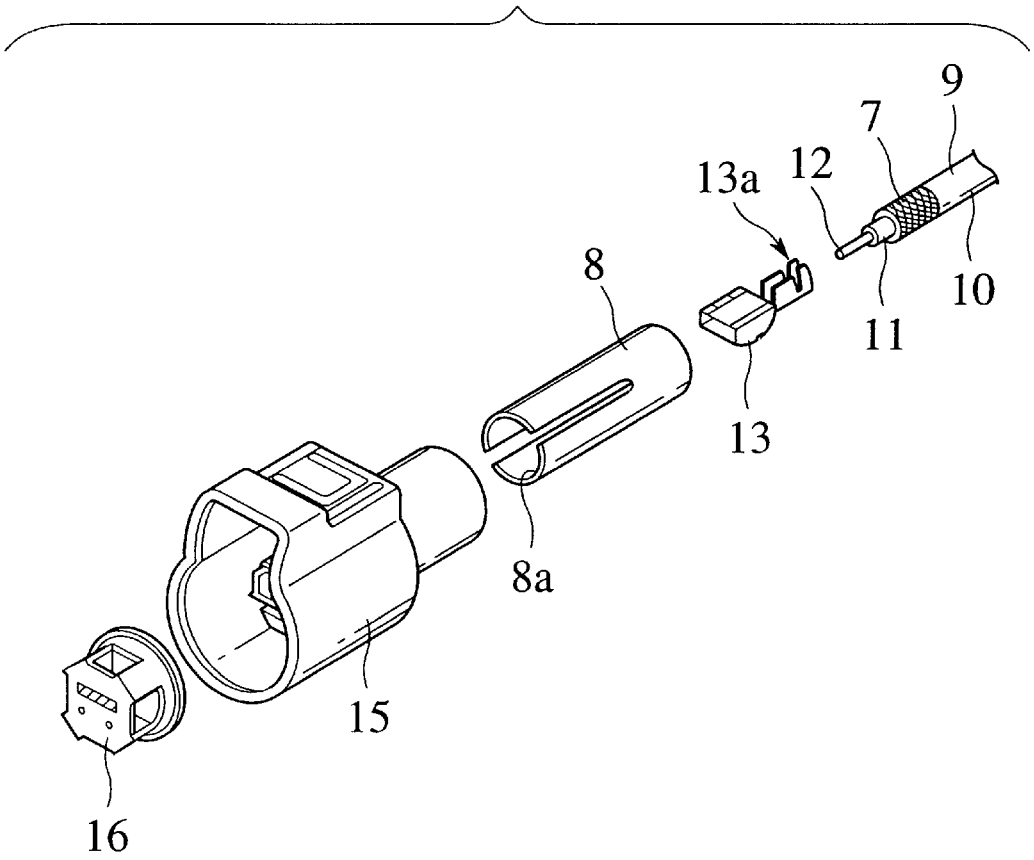
FIG.2 PRIOR ART
FIG. 2 is a disassembly perspective view showing another conventional connecting structure for the shielded wire.
Figure 3:
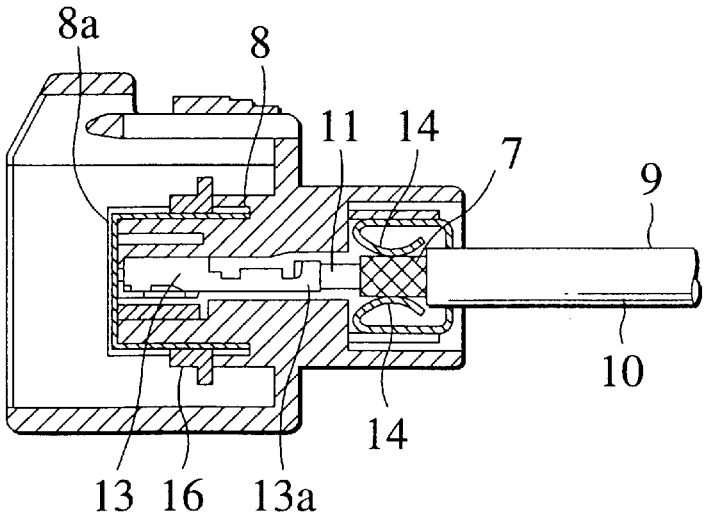
FIG.3 PRIOR ART
FIG. 3 is a sectional view showing a connecting structure for the shielded wire of FIG. 2.

There will be detailed below the preferred embodiments of the present invention with reference to the accompanying drawings. Like members are designated by like reference character.

First Embodiment

Figure 4A:
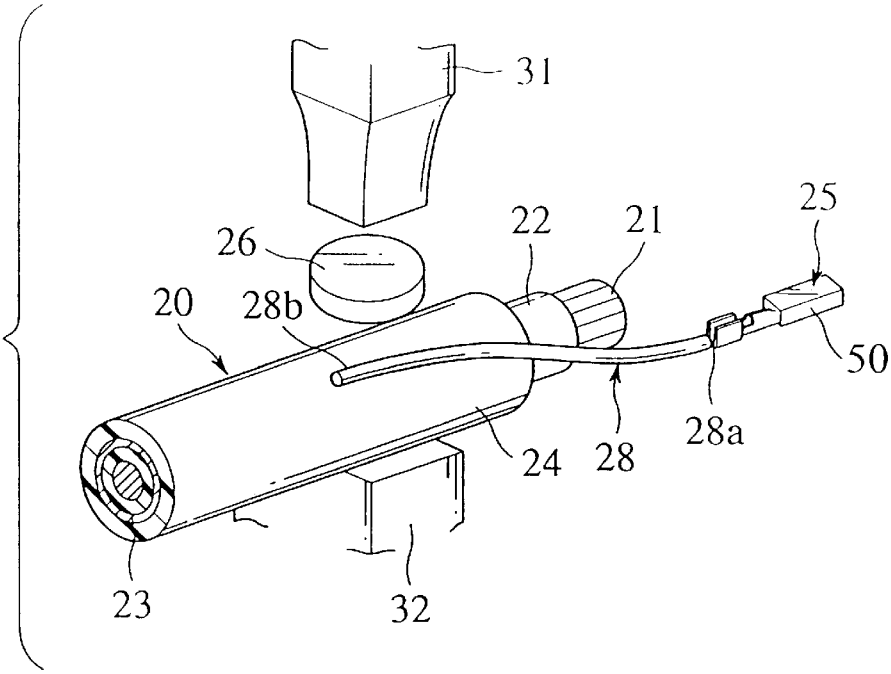
Figure 4B:
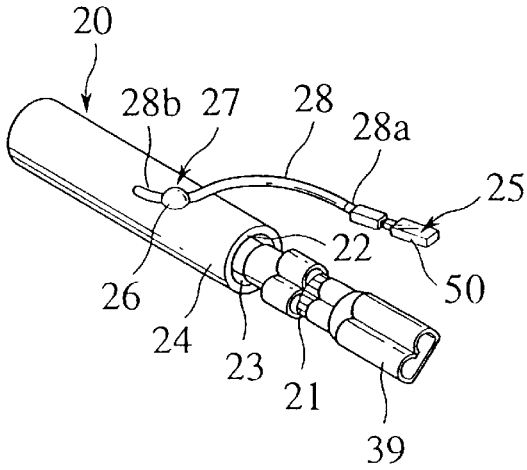
Figure 5A:
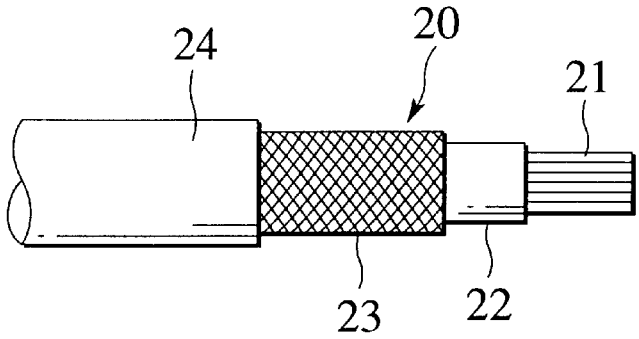

As shown in FIGS. 4A, 5A, 56B, a shielded wire 20 for use in this embodiment comprises core 21, core cover 22 for covering the core 21, braid 23 provided around the core cover 22 for shielding, and insulating outer cover 24 made of resin provided around the braid 23 for covering the core 21, core cover 22 and braid 23. A shield terminal 25 comprises a lead wire 28 attached at an end 28*a* to a terminal metal 50 and conductively connected to the braid 23 at a portion between the attached end 28*a* and an unattached end 28*b*.

According to the connecting structure of this embodiment, an end of a shield terminal 25 is placed on the insulating outer cover 24 and a resin chip 26 is placed on this end of the shield terminal 25. Then, ultrasonic vibration is applied on the resin chip 26 so as to melt and disperse the insulating outer cover 24, so that a shielded conductive portion 27 in which the end 28*b* of the shield terminal 25 is conductively in contact with the braid 23 is formed.

Figure 7:
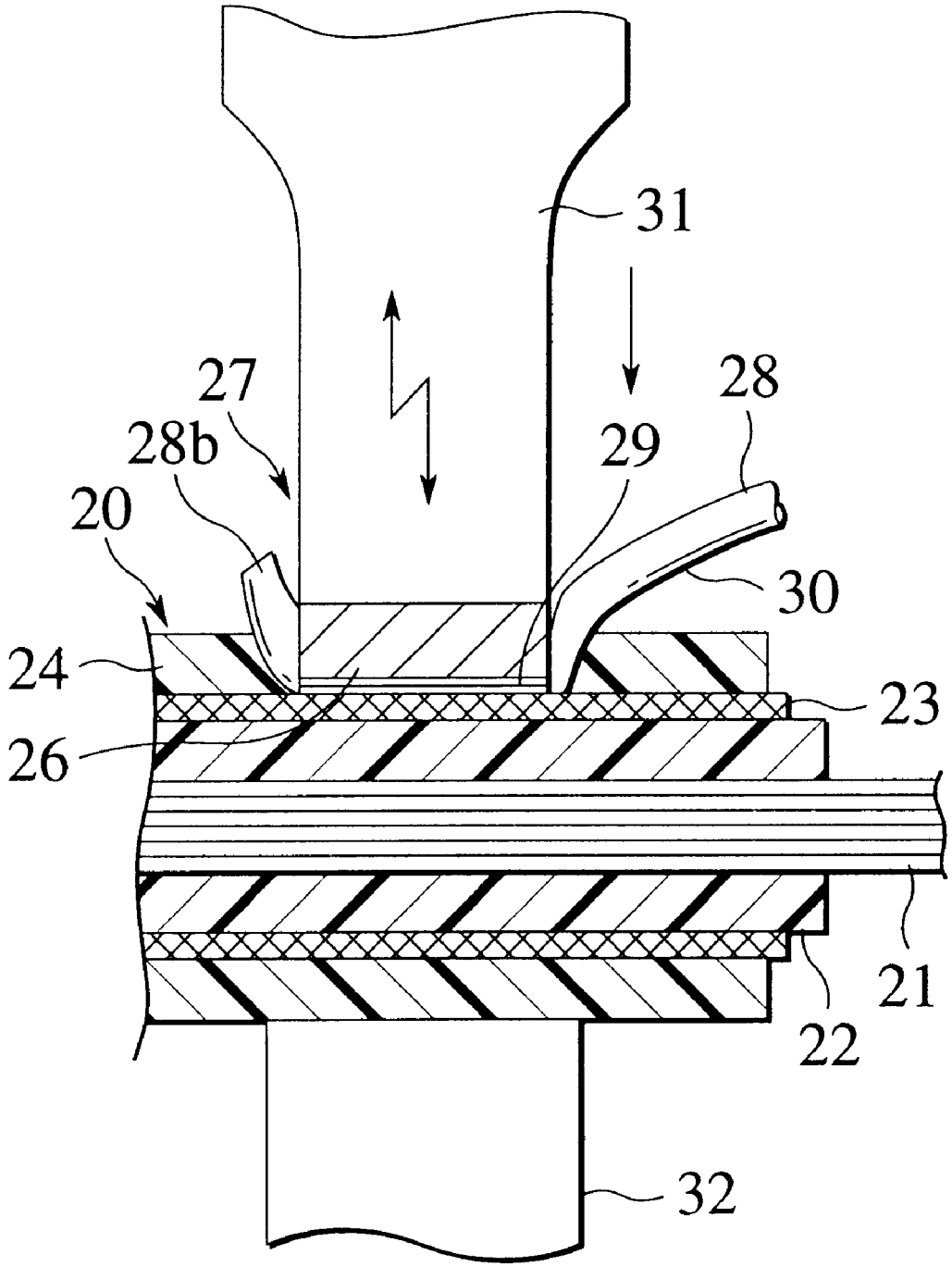
FIG. 7 is a sectional view showing a state in which the unattached end of the lead wire is placed on the insulating outer cover of the shielded wire, then a resin chip is placed thereon ultrasonic vibration is applied.

An end 28*a* of a lead wire 28 is crimped to an end of the terminal metal 50. As shown in FIG. 7, this lead wire 28 is constituted of a covered wire in which a periphery of a conductor 29 is covered with an insulator 30 made of resin.

Figure 6:
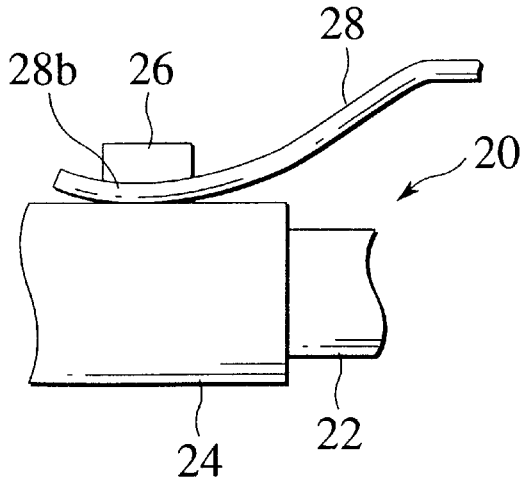
FIG. 6 is a side view showing a state in which the unattached end of the lead wire is placed on the insulating outer cover of the shielded wire and a resin chip is placed thereon.

As shown in FIG. 6, the other end of the lead wire 28*b* is placed on the insulating outer cover 24 of an end portion and the resin chip 26 is placed thereon. Then, the portion on which the resin chip 26 is placed is disposed between ultrasonic horns 31 and 32. By ultrasonic vibration, the insulating outer cover 24 and insulator 30 of the lead wire 28 are melted and dispersed, so that the braid 23 is conductively in contact with the conductor 29 so as to form the shielded conductive portion 27.

In this shielded conductive portion 27, the resin chip 26 passes through the insulating outer cover 24 so that the braid 23 and conductor of the lead wire 28 are nipped between the outer periphery of the core cover 22 and a bottom face of the resin chip 26. As a result, the braid 23 is conductively in contact with the conductor 29 of the lead wire 28 and then the braid 23 is conductively in contact with the shield terminal 25 through the lead wire 28 and the terminal metal 50.

The aforementioned resin chip 26 is more difficult to be melted than the insulating outer cover 24 on which the lead wire 28 is placed, and is made of acrylic resin, ABS (acrylonitrile-butadiene-styrene copolymer) resin, PC (polycarbonate) resin, PE (polyethylene) resin, PEI (polyetherimide), PBT (polyethylene terephtalate) or the like. Generally, the material of the resin chip 26 is harder than vinyl chloride used for the insulating outer cover 24 and insulator 30 of the lead wire 28. With respect to the suitability of these resins for use as the resin chip 26, excellent applicability can be recognized in all the resins in term of conductivity and conductive stability, and if judging from appearance and insulation property as well, particularly PEI resins and PBT resins are suitable for the resin chip.

Next, a processing method according to this embodiment will be described.

Figure 5B:
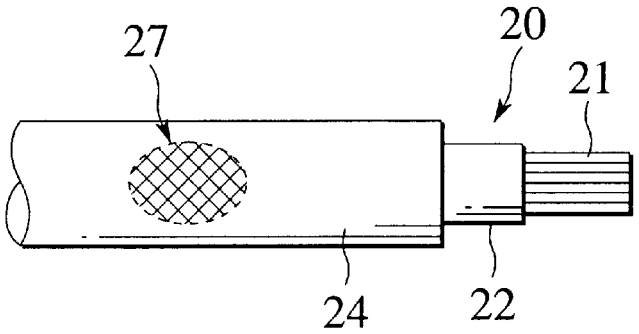

First, an end portion of the shielded wire 20 is processed as shown in FIG. 5B. That is, an end portion of the core 21 is exposed together with the core cover 22 and then by removing the core cover 22, only the end portion of the core 21 is exposed. In this condition, the braid 23 is covered with the insulating outer cover 24 so that the wire 23 is not exposed.

With this condition, as shown in FIG. 6, an end portion 28*b* of the lead wire 28 is placed on the insulating outer cover 24 and the resin chip 26 is placed on the lead wire 28. Then, as shown in FIG. 4A, this portion in which the resin chip 26, lead wire 28 and insulating outer cover 24 are overlaid is nipped between the ultrasonic horns 31 and 32, and then ultrasonic vibration is applied to a top portion of the resin chip 26 together with a pressure.

If ultrasonic vibration is applied to the top portion of the resin chip 26, a heat is generated inside thereof by ultrasonic energy so that the insulator 30 of the lead wire 28 and insulating outer cover 24 are melted and dispersed. As a result, the resin chip 26 invades into the insulating outer cover 24 and the braid 23 and conductor 29 of the lead wire 28 are nipped between the bottom face of the resin chip 26 and the outer periphery of the core cover 22. In this condition, the braid 23 is conductively in contact with the lead wire 28. As a result, the braid 23 is conductively in contact with the shield terminal 25 through the lead wire 28 and the terminal metal 50.

A side face of the resin chip 26 is fused with the insulating outer cover 24 and the bottom face of the resin chip 26 is fused with the core cover 22. Therefore, the resin chip 26 never drops off.

By winding a tape over the shielded conductive portion 27 in which the resin chip 26 has invaded into the insulating outer cover 24, the resin chip 26 is prevented from falling down.

According to the connecting structure and processing method of this embodiment, a procedure for removing the insulating outer cover 24 to expose the braid 23 is not necessary. Further, by placing the unattached end 28*b* of the lead wire 28 on the insulating outer cover 24 and applying ultrasonic vibration with the resin chip 26 overlaid thereon, the braid 23 and shield terminal 25 can be joined together easily, so that the end portion of the shielded wire can be processed quickly.

Further, according to this embodiment, because no housing or cap for accommodating the shield terminal 25 is necessary, a simple connecting structure is formed.

Further, according to this embodiment, because a procedure for removing covering is not necessary for connecting the shield terminal 25 to the braid 23, it is possible to connect the shield terminal 25 and braid 23 to each other at a final step so that this procedure can be automated.

In the above embodiment, the shield terminal 25 is connected to the braid 23 through the lead wire 28 by joining the end 28*b* of the lead wire 28, the other end 28*a* of which is connected to the terminal metal 50, to the braid 23. Further, it is also possible to connect the braid 23 directly to the terminal metal 50 by placing one side of the terminal metal 50 just on the insulating outer cover 24 and applying ultrasonic vibration to the resin chip 26 placed thereon so as to melt and disperse only the insulating outer cover 24.

According to this embodiment, because the portion of the core cover 22 not covered with the braid 23 is very small, the shielding performance never drops.

Although this embodiment has been described about the connecting structure and processing method for the end portion of the shielded wire 20, the present invention can be applied to an intermediate portion of the shielded wire 20 as well as the end portion so as to connect the shield terminal 25 thereto.

Other embodiments of the present invention will be described. The same reference numerals are attached to the same components as the first embodiment and a description thereof is omitted.

Second Embodiment

Figure 8:
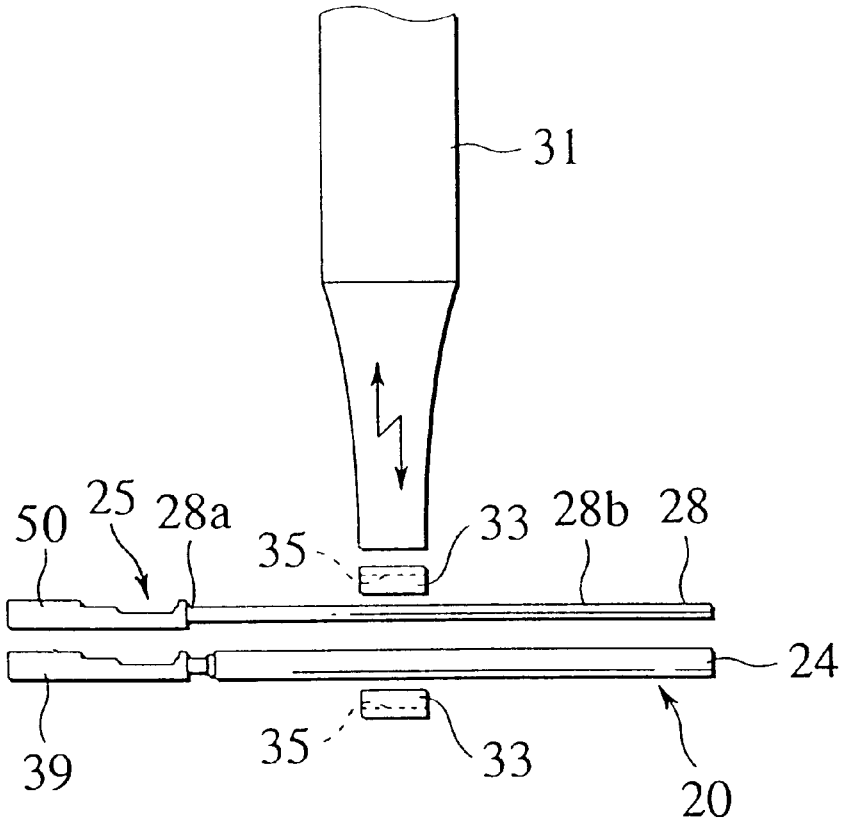
FIG. 8 is a side view showing a state before the shielded wire is connected to the shield terminal, according to a second embodiment.
Figure 9:
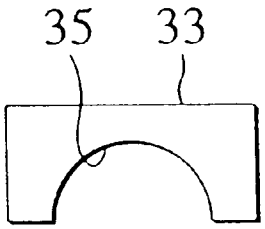
FIG. 9 is a side view showing a resin chip according to the second embodiment.
Figure 10:
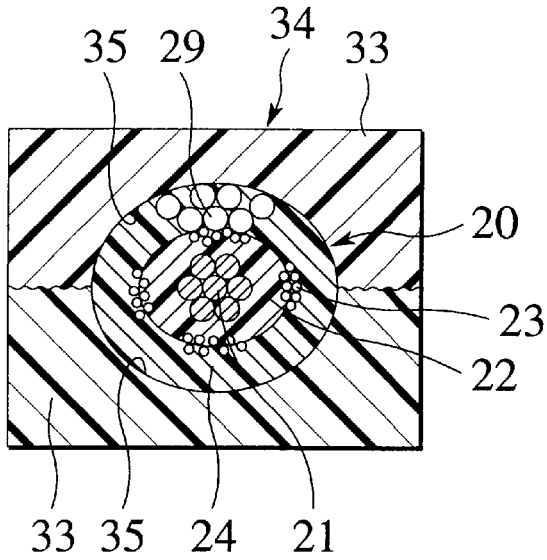
FIG. 10 is a sectional view showing a shielded conductive portion according to the second embodiment.

According to a connecting structure for the shielded wire of this embodiment, as shown in FIGS. 8, 10, the lead wire 28 and shielded wire 20 are nipped between a pair of resin chips 33, 33 and ultrasonic vibration is applied so as to form the a shielded conductive portion 34.

The resin chip 33 is a cylinder having a low height and a concave portion 35 which is arcuate along an outer shape of the shielded wire 20 is formed on a mounting face of the resin chip 33 relative to the insulating outer cover 24 so as to pass through in the diameter direction. This resin chip 33 is made of the same material as the resin chip 26 of the aforementioned first embodiment.

Then, as shown in FIG. 8, the unattached end 28*b* of the lead wire 28, connected on the other end 28*a* to the terminal metal 50, and the shielded wire 20 are nipped between two resin chips 33, 33 and ultrasonic vibration is applied with a pressure applied to the resin chips 33, 33 by the horn 31. As a result of ultrasonic vibration, a heat is generated inside of the chips 33, 33 due to ultrasonic energy and the generated heat melt and disperse the insulating outer cover 24 and insulator 30 of the lead wire 28. Further, due to a pressure, the conductor 29 is conductively in contact with the braid 23. Due to the ultrasonic vibration, mating faces of the resin chips 33, 33 are fused with each other. As a result, the shielded conductive portion 34 is formed. In this condition, the shielded wire 20 is nipped between the resin chips 33, 33.

According to this embodiment, by applying ultrasonic vibration with the lead wire 28 and shielded wire 20 nipped between the two resin chips 33 and 33, the conductor 29 of the lead wire 28 can be conductively connected to the braid 23 easily. Therefore, the procedure for removing the insulating outer cover 24 is not necessary so that connection between the braid 23 and shield terminal 25 in the shielded wire 20 can be carried out easily and quickly.

Because no housing or cap for accommodating the shield terminal 25 is necessary, the number of parts is reduced so that a simple connecting structure is assured.

According to this embodiment, because a procedure for removing covering of the insulating outer cover 24 is not necessary for connecting the lead wire 28 joined to the terminal metal 50 to the braid 23, it is possible to connect the shield terminal 25 and braid 23 to each other at a final step so that this procedure can be automated.

Further, according to this embodiment, the shield terminal 25 can be connected to the braid 23 at a portion other than the end portion of the shielded wire 20. Therefore, the braid 23 can be conductively connected to the shield terminal 25 at any position of the shielded wire 20. At that time, the procedure for removing the insulating outer cover 24 is not necessary and therefore the connection between the shield terminal 25 and braid 23 can be carried out easily.

Further, because the resin chip 33 of this embodiment has the concave portion 35 of an arcuate shape, when the resin chip 33 is placed on the insulating outer cover 24 of the shielded wire 20 and a pressure is applied thereto, the insulating outer cover 24 can be protected from tearing or cutting and further ultrasonic vibration can be transmitted to the insulating outer cover excellently.

Next, a modification shown in FIGS. 11, 12 will be described.

Figure 11:
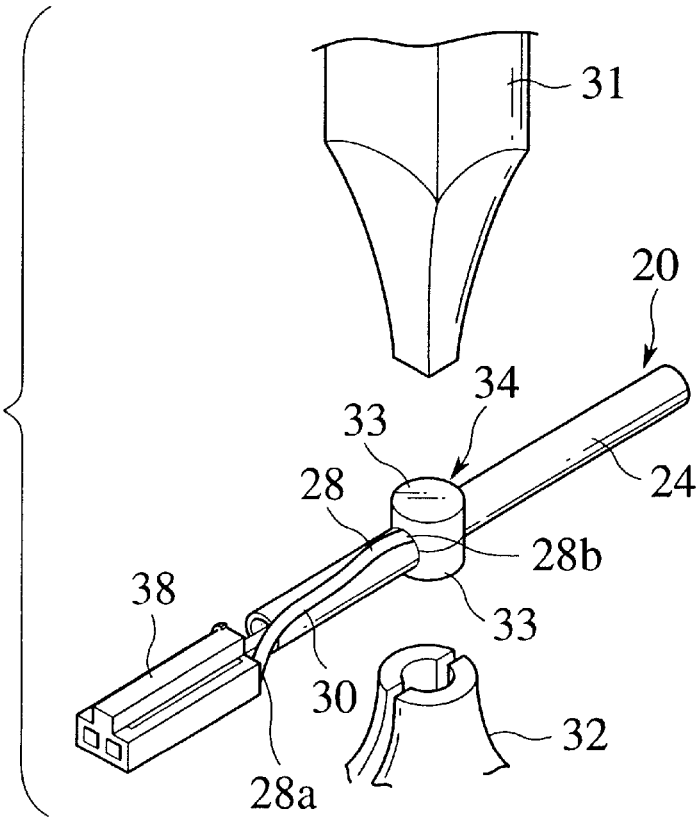
FIG. 11 is a perspective view showing a state in which a terminal connected to a core and a terminal metal are accommodated integrally in a housing, indicating a modification of the second embodiment.

FIG. 11 shows an example in which a terminal 39 (see FIG. 8) connected to an end of the core 21 of the shielded wire 20 and the terminal metal 50 (see FIG. 8) are accommodated in a single connector housing 38. An end 28*a* of the lead wire 28 is connected to the terminal metal 50 and the other end 28*b* of the lead wire 28 is conductively connected to the braid 23 through the connecting structure of the above described embodiment.

In this example, the structure of the end portion of the shielded wire 20 is simple and small. If the terminal connected to the core 21 of the shielded wire 20 and the terminal metal 50 are accommodated in the connector housing 38 and finally the end of the lead wire 28 is connected to the braid 23 of the shielded wire 20, the end portion of the shielded wire 20 can be processed easily.

In this case, the conductor 29 of the lead wire 28 can be made into a conductive contact with the braid 23 at any time, freedom of design of production line is improved thereby making it possible to reduce production cost.

Figure 12:
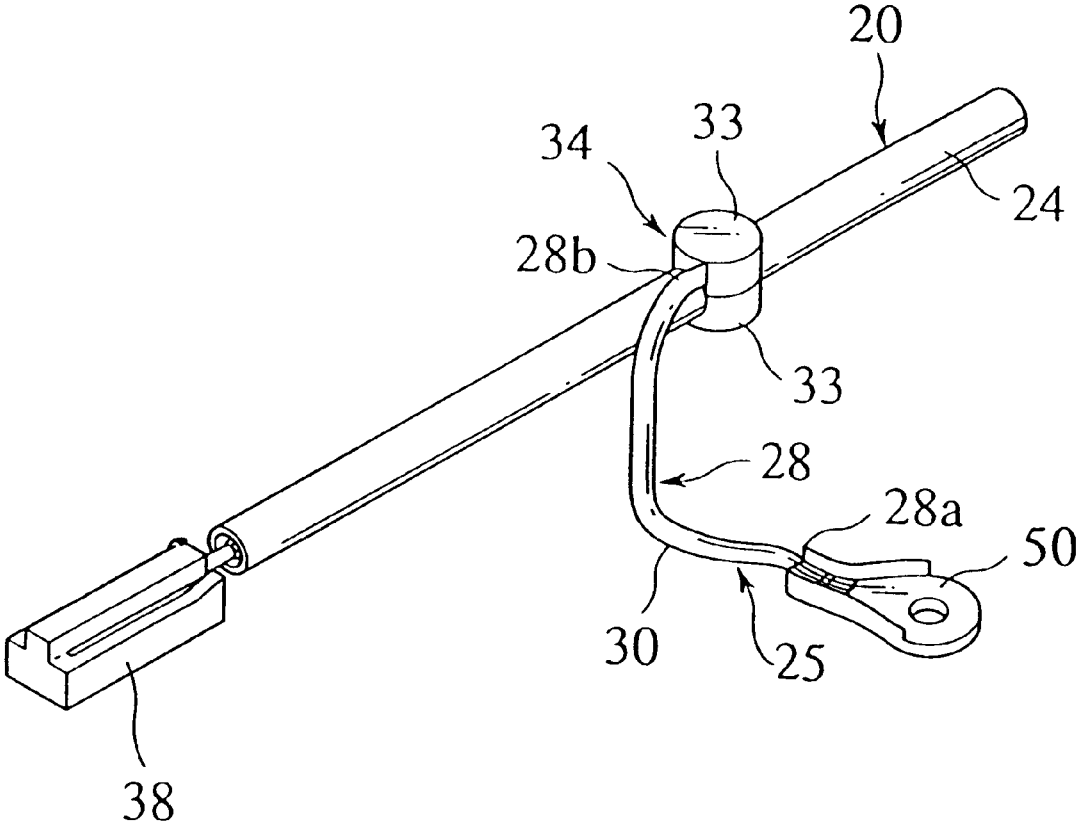
FIG. 12 is a perspective view showing a state in which the shield terminal is connected to the braid at a portion other than the end portion of the shielded wire, indicating another modification of the second embodiment.

FIG. 12 shows an example in which the shield terminal 25 is joined to the braid 23 at a portion other than the end portion of the shielded wire 20.

Because in this example, the braid 23 can be joined to the shield terminal 25 at any position other than the end portion of the shielded wire, the number of steps for processing the end portion of the shielded wire 20 is reduced so that working efficiency is raised.

Third Embodiment

Figure 13:
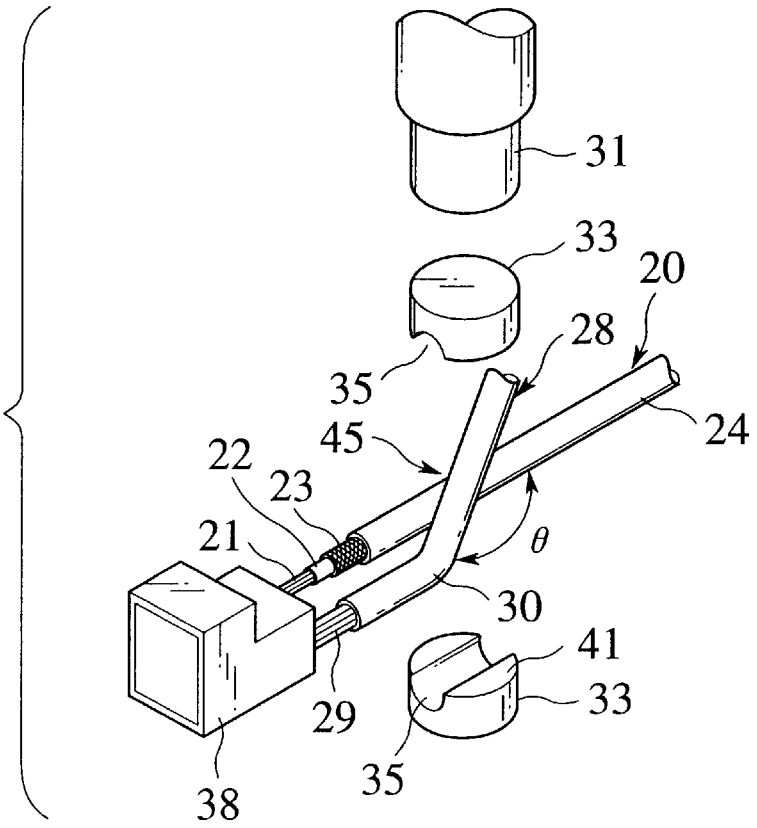
FIG. 13 is a perspective view showing a crossing state of the lead wire and shielded wire according to a third embodiment.
Figure 14:
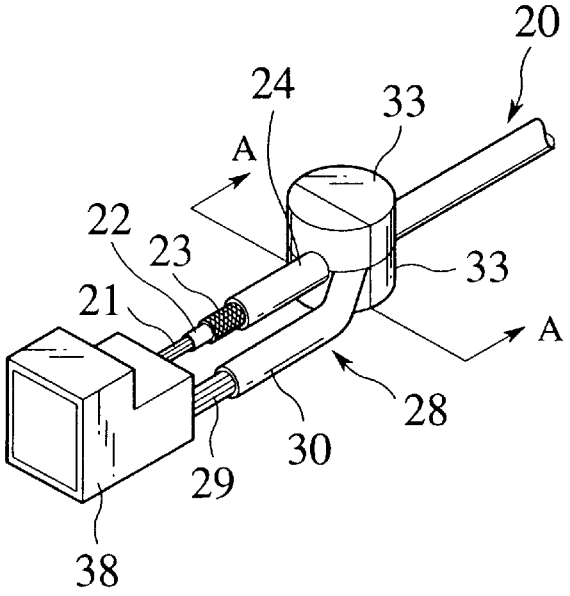
FIG. 14 is a perspective view showing a state in which the resin chips are fused with each other according to the third embodiment.
Figure 15:
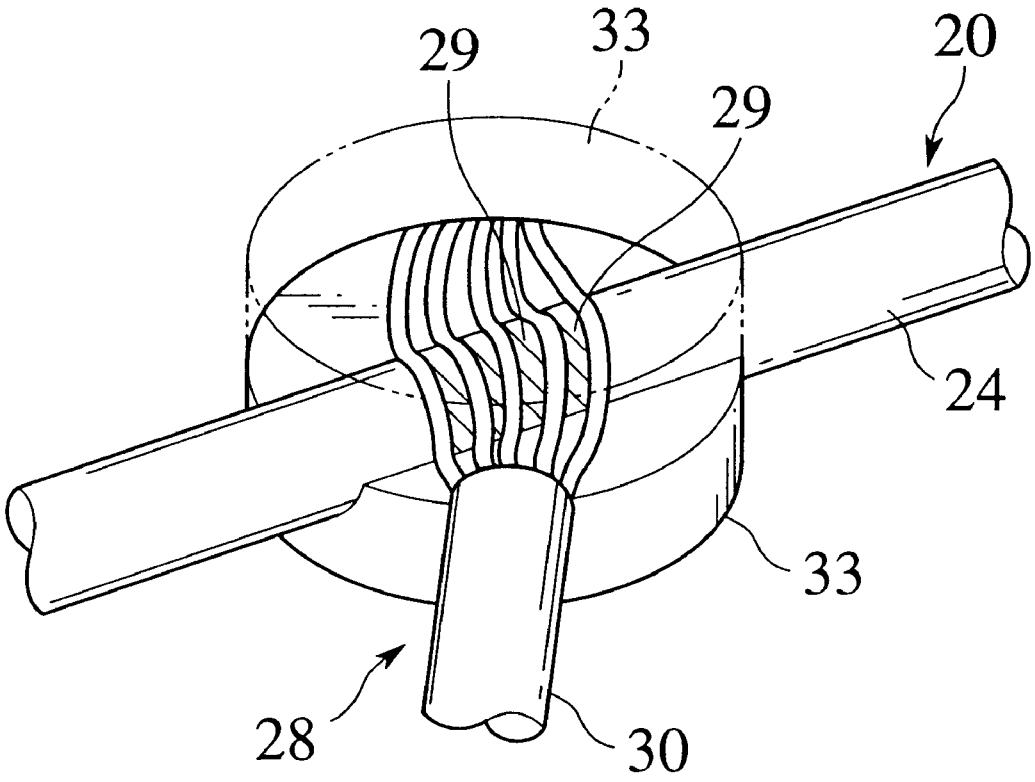
FIG. 15 is a perspective view showing an interior of the resin chip according to the third embodiment.

According to the connecting structure for the shielded wire of this embodiment, as shown in FIGS. 13–15, the lead wire 28 is placed so as to cross the shielded wire 20 and this crossed portion 45 is nipped between a pair of the resin chips 33. Then, by applying ultrasonic vibration in this condition, the conductor 29 of the lead wire 28 is made into a conductive contact with the braid 23 of the shielded wire 20.

That is, the lead wire 28 is disposed so as to cross the shielded wire 20 at an angle θ as shown in FIG. 13 and placed on the insulating outer cover 24 of the shielded wire 20. Then, this crossed portion 45 is nipped between a pair of the resin chips 33. At this time, the crossed portion 45 of the shielded wire 20 and lead wire 28 is inserted into the concave portion 35 of the pair of the resin chips 33, so that the crossed portion 45 is held stably by this insertion.

After a pair of the resin chips 33 are nipped, ultrasonic vibration is applied to the resin chips 33 by a pair of ultrasonic horns 31 with a pressure applied from up and down. A heat is generated inside of the resin chips due to ultrasonic energy of this ultrasonic vibration, so that the insulator 30 of the lead wire 28 and the insulating cover of the shielded wire 20 are melted and dispersed. As a result, the conductor 29 of the lead wire 28 and braid 23 of the shielded wire 20 are made into conductive contact with each other. Further, the resin chips 33 are fused with each other through their mating faces.

A feature of this embodiment is that the lead wire 28 crosses the shielded wire 20. By this crossing, the conductor 29 of the lead wire 28 becomes loose so that contacts thereof with the braid 23 increases, thereby ensuring a stabilized electrical connection. Next, an operation of this embodiment will be described.

Figure 18:
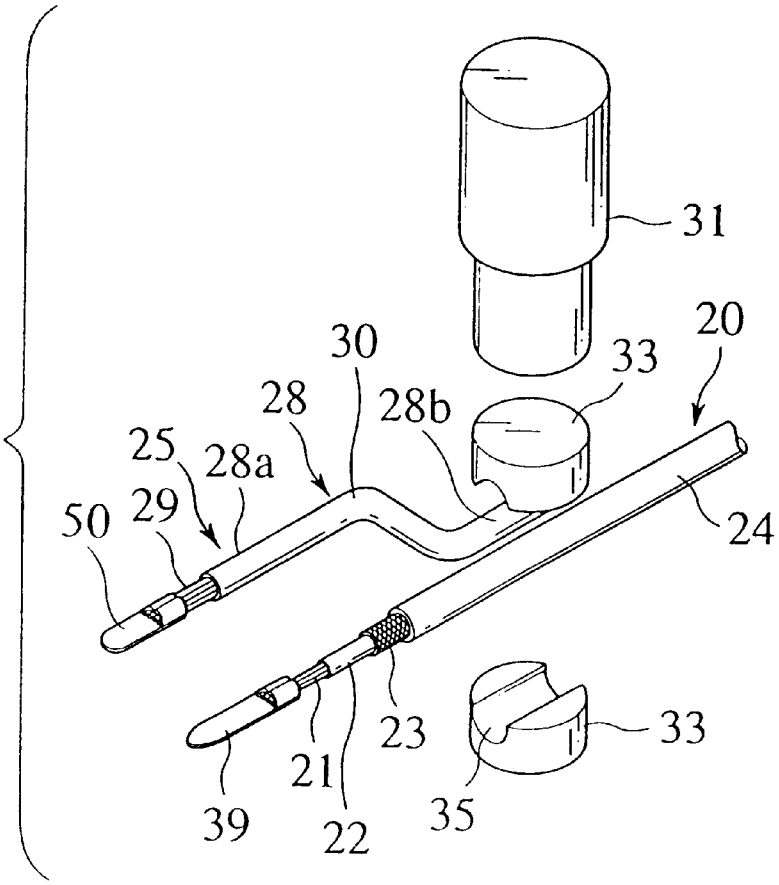
FIG. 18 is a perspective view prior to application of ultrasonic vibration, indicating a precedent structure according to the third embodiment.
Figure 19:
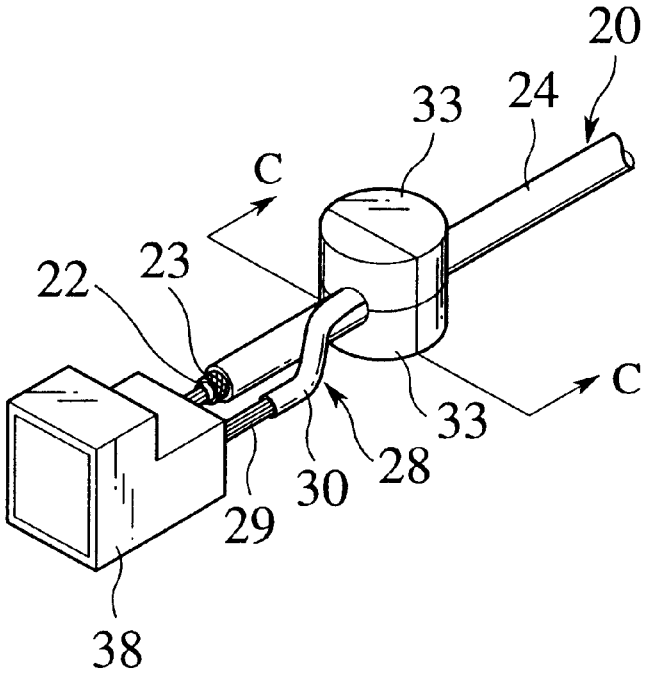
FIG. 19 is a perspective view after application of ultrasonic vibration indicating a precedent structure according to the third embodiment.
Figure 20:
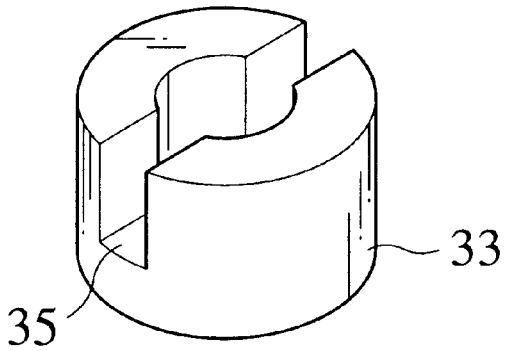
FIG. 20 is a perspective view of the resin chip for use in the precedent structure according to the third embodiment.

FIGS. 18, 19 show an example in which the lead wire 28 is placed on the insulating outer cover 24 in parallel without crossing the shielded wire 20 and nipped between a pair of the resin chips 33 and ultrasonic vibration is applied with a pressure applied by the ultrasonic horn 31. By this ultrasonic vibration, the insulator 30 of the lead wire 28 and insulating outer cover 24 of the shielded wire 20 are melted and dispersed, so that the conductor 29 of the lead wire 28 is joined to the braid 23 of the shielded wire 20 so as to obtain conductivity therebetween. As the resin chip 33 for use in this case, a type in which the concave portion 35 is deeper as shown in FIG. 20 is also available. Consequently, an overlapping portion of the lead wire 28 and shielded wire 20 can be accommodated in the concave portion 35 securely.

Figure 21A:
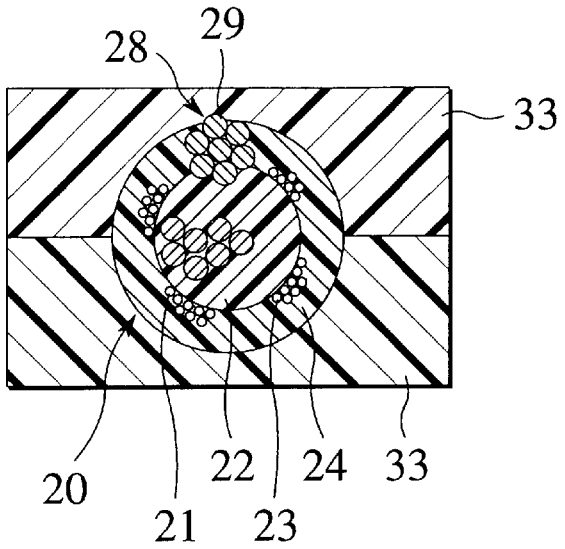
Figure 21B:
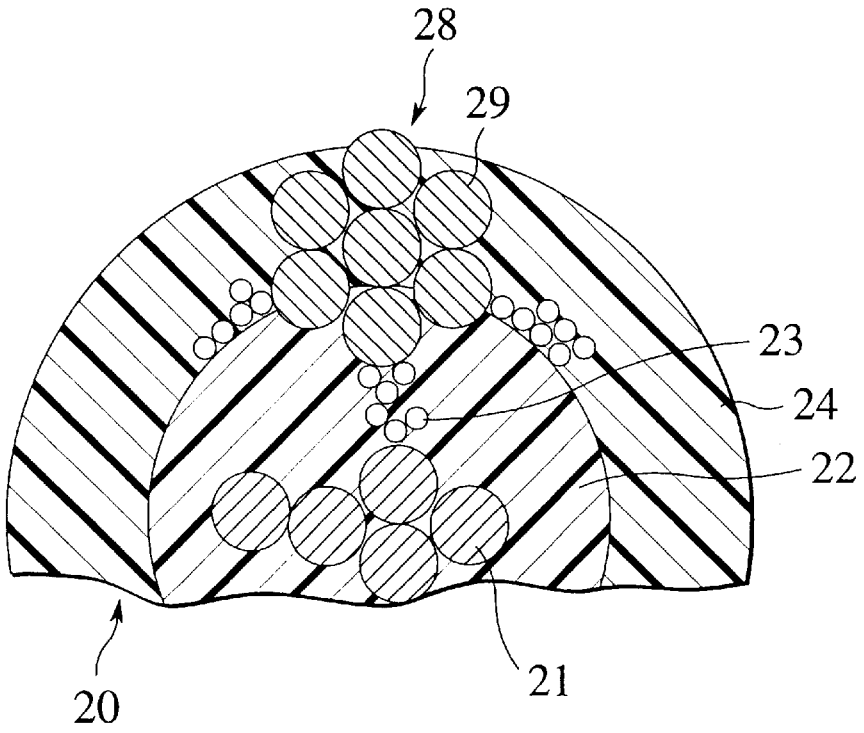

In case when the lead wire 28 is overlapped with the shielded wire 20 such that they are parallel to each other and ultrasonic vibration is applied with a pressure applied to the resin chips 33 up and down, as shown in FIG. 21A, the conductor 29 of the lead wire 28 sinks largely deforming the core cover 22 of the shielded wire 20 in a condition that the conductor 29 of the lead wire 28 is not made loose but integral. Finally, as shown in FIG. 21B, the conductor 29 directly contacts the core 21 of the core cover 22 or contacts the core 21 via the braid 23. Due to this contact, there may occurs an inconvenience that the lead wire 28 is made conductive with the shielded wire 20.

Further, because the conductor 29 is not made loose, the conductor 29 cannot be fused firmly with the resin chip 33. Thus, the tensile strength is small and therefore there may occur a problem that the lead wire 28 slips out easily by a small pulling force.

On the contrary, in this embodiment in which the lead wire 28 is placed to cross the shielded wire 20 at a crossing angle θ and then ultrasonic vibration is carried out, when the insulator 30 of the lead wire 28 is melted, the conductor 29 is made loose by ultrasonic vibration as shown in FIG. 15, so that individual pieces of the conductor 29 come into contact with the braid 23. Therefore, the contacts of the conductor 29 with the braid 23 increases, thereby achieving a stabilized conductive state.

Figure 16A:
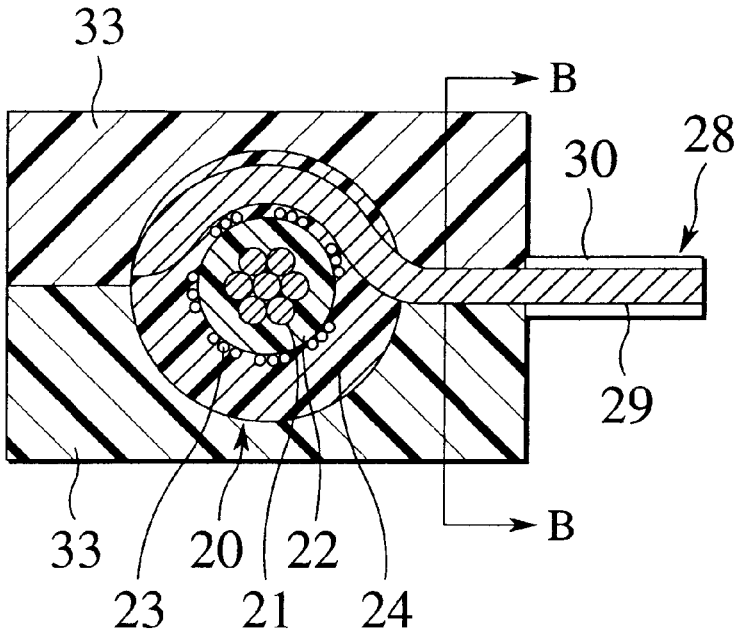
Figure 16B:
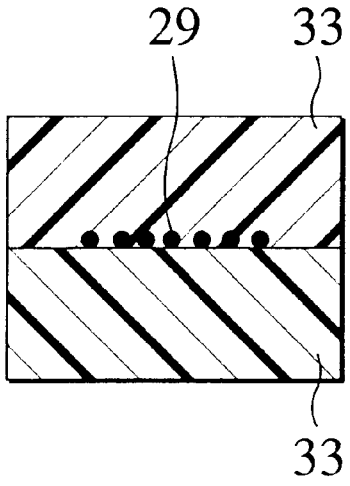

By the ultrasonic vibration, the conductor 29 is made loose in an entire range nipped by the resin chips 33, so that as shown in FIG. 16A, the conductor 29 becomes loose in the other range than the portion which is in contact with the braid 23. If the conductor 29 becomes loose, as shown in FIG. 16B, the resin of the melted resin chip 33 is filled in between the conductors 29. As a result, a lifting force between the resin chip 33 and conductor 29 increases so that the tensile strength is intensified and therefore the lead wire 28 becomes difficult to loose.

The crossing angle θ at which the lead wire 28 crosses the shielded wire 20 is preferred to be 45°–135°. If the angle θ is less than 45°, the angle of the lead wire 28 is small so that a degree of loosening of the conductor 29 by ultrasonic vibration is low and therefore the aforementioned operation cannot be exerted excellently. If the angle θ is more than 135°, the angle between the lead wire 28 and shielded wire 20 is too large so that it is difficult to accommodate the terminal metal 50 of the lead wire 28 and terminal 39 of the shielded wire 20 in the same connector housing 38.

Table 1 was obtained by this inventor through experiments to obtain a range of optimum θ. A circle indicates a good result and a cross indicates a wrong result.

TABLE 1

| | Electrical characteristic | Tensile strength | breaking mode |
|---|---|---|---|
| 30° | X | X | slip |
| 45° | ○ | ○ | cut |
| 60° | ○ | ○ | cut |
| 90° | ○ | ○ | cut |

Figure 17:
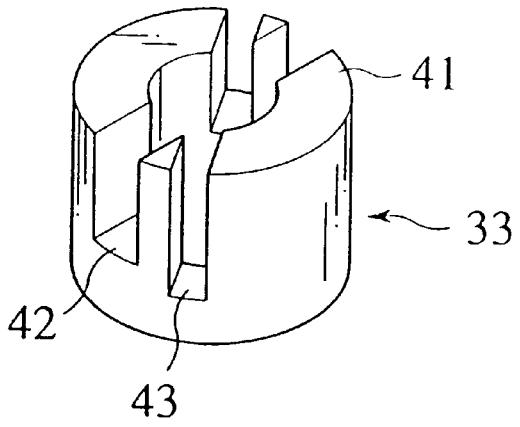
FIG. 17 is a perspective view showing an example of the resin chip for use in the third embodiment.

FIG. 17 shows an example of the resin chip 33 which can be used for this embodiment. The mounting face 41 to be fit to a mating resin chip is open and crossing grooves 42, 43 are formed. The shielded wire 20 is inserted in the crossing groove 42 and the lead wire 28 is inserted in the crossing groove 43. These crossing grooves 42, 43 cross each other at the intermediate portion so that the inserted shielded wire 20 and lead wire 28 can be placed to cross each other and further the crossing condition can be held securely. Therefore, by applying ultrasonic vibration to this resin chip 33, the conductor 29 of the lead wire 28 can be made loose to be joined more securely to the braid 23.

Although the lead wire 28 in which the conductor 29 is covered with the insulator 30 is used in the above respective embodiments, it is permissible to use a tinned wire instead of that lead wire 28 thereby flirter improving a connection reliability.

While preferred embodiments of the present invention have been described using specific terms, such description is for illustrative purposes, and it is to be understood that changes and variations may be made without departing from the spirit or scope of the following claims.

What is claimed is:

1. A connecting structure for a shielded wire, comprising:

a shielded wire having a core made of a conductor, a core cover for covering the core, a braid provided around the core cover for shielding, and an insulating outer cover provided around the braid for covering the core, core cover and braid; and a shield terminal having a lead wire attached at an end to a terminal metal and conductively connected at a portion between the attached end and an unattached end to the braid of the shielded wire, wherein said structure is formed by:

placing said portion of the lead wire of the shield terminal on the insulating outer cover of the shielded wire;

placing at least one resin chip on said portion of the lead wire of the shield terminal; and applying an ultrasonic vibration so as to melt and disperse the insulating outer cover of the shielded wire, thereby bringing the shield terminal and the braid conductively in contact with each other.

2. A connecting structure for a shielded wire according to claim 1, the lead wire having a core made of a conductor and an insulating outer cover provided around a periphery of this conductor and made of resin, wherein by application of ultrasonic vibration, the insulating outer cover of the lead wire is melted and dispersed together with the insulating outer cover of the shielded wire, thereby bringing the conductor of the lead wire and the braid of the shielded wire conductively in contact with each other.

3. A connecting structure for a shielded wire according to claim 1, wherein said portion of the lead wire is placed on the insulating outer cover of the shielded wire in a condition that said portion of the lead wire crosses the shielded wire, the resin chip is placed on said portion of the lead wire at an intersection with the shielded wire, and ultrasonic vibration is applied.

4. A connecting structure for a shielded wire according to claim 3, wherein said portion of the lead wire is placed on the insulating outer cover of the shielded wire in a condition that said portion of the lead wire crosses the shielded wire at a crossing angle of 45°–135°, the resin chip is placed on said portion of the lead wire at the intersection with the shielded wire, and ultrasonic vibration is applied.

5. A connecting structure for a shielded wire according to claim 3, wherein a mounting face of the resin chip relative to the insulating outer cover of the shielded wire is provided with a first and a second crossing groove to support the intersecting lead wire and shielded wire at a restricted crossing angle.

6. A connecting structure for a shielded wire according to claim 5, wherein the crossing angle at the intersection of the lead wire and the shielded wire is 45°–135°.

7. A connecting structure for a shielded wire according to claim 1, wherein a mounting face of the resin chip relative to the insulating outer cover of the shielded wire is provided with a concave portion, said concave portion being arcuate along an outer shape of the shielded wire.

8. A connecting structure for a shielded wire according to claim 1, wherein said portion of the lead wire of the shield terminal and the shielded wire are nipped between a pair of resin chips, including the at least one resin chip, and ultrasonic vibration is applied so as to melt and disperse at least the insulating outer cover of the shielded wire and fuse the resin chips to each other.

9. A processing method for conductively connecting a shielded wire, comprising;

placing a portion of a lead wire of a shield terminal on an insulating outer cover of a shielded wire, the shielded wire having a core made of a conductor, a core cover for covering the core, a braid provided around the core cover for shielding, and the insulating outer cover provided around the braid for covering the core, core cover and braid, the shield terminal having the lead wire attached at an end to a terminal metal and to be conductively connected at said portion between the attached end and an unattached end to the braid of the shielded wire;

placing a resin chip on said portion of the lead wire of the shield terminal; and applying an ultrasonic vibration so as to melt and disperse the insulating outer cover of the shielded wire, thereby bringing the shield terminal and the braid conductively in contact with each other.

10. A processing method for conductively connecting a shielded wire according to claim 9, the lead wire having a core made of a conductor and an insulating outer cover provided around a periphery of this conductor and made resin, wherein said portion is placed on the insulating outer cover of the shielded wire and ultrasonic vibration is applied so as to melt and disperse the insulating outer cover of the lead wire together with the insulating outer cover of the shielded wire, bringing the conductor of the lead wire and the braid of the shielded wire conductively in contact with each other.

11. A processing method for conductively connecting a shielded wire, comprising;

placing a portion of a lead wire of a shield terminal on an insulating outer cover of a shielded wire, the shielded wire having a core made of a conductor, a core cover for covering the core, a braid provided around the core cover for shielding, and the insulating outer cover provided around the braid for covering the core, core cover and braid, the shield terminal having the lead wire attached at an end to a terminal metal and to be conductively connected at said portion between the attached end and an unattached end to the braid of the shielded wire;

nipping said portion of the lead wire of the shield terminal and the shielded wire between a pair of resin chips; and applying an ultrasonic vibration so as to melt and disperse at least the insulating outer cover of the shielded wire, thereby bringing the shield terminal and the braid conductively in contact with each other.

12. A processing method for conductively connecting a shielded wire according to claim 11, the lead wire having a core made of a conductor and an insulating outer cover provided around a periphery of this conductor and made of resin, wherein said portion is placed on the insulating outer cover of the shielded wire and ultrasonic vibration is applied so as to melt and disperse the insulating outer cover of the lead wire together with the insulating outer cover of the shielded wire, bringing the conductor of the lead wire and the braid of the shielded wire conductively in contact with each other.

13. A processing method for conductively connecting a shielded wire, comprising;

placing a portion of a lead wire of a shield terminal on an insulating outer cover of a shielded wire so that said portion of the lead wire of the shield terminal crosses the shielded wire, the shielded wire having a core made of a conductor, a core cover for covering the core, a braid provided around the core cover for shielding, and an insulating outer cover provided around the braid for covering the core, core cover and braid, the shield terminal having the lead wire attached at an end to a terminal metal and placed at said portion between the attached end and the unattached end of the lead wire on the insulating outer cover of the shielded wire in a condition that said portion crosses the shielded wire, to be conductively connected to the braid of the shielded wire;

nipping said crossing portion of the lead wire of the shield terminal and the shielded wire between a pair of resin chips; and applying an ultrasonic vibration so as to melt and disperse at least the insulating outer cover of the shielded wire, thereby conductively connecting the lead wire and the shielded wire.

14. A processing method for conductively connecting a shielded wire according to claim 13, wherein said portion of the lead wire and the shielded wire cross each other at a crossing angle of 45°–135°.

15. A processing method for conductively connecting a shielded wire according to claim 13, the lead wire having a core made of a conductor and an insulating outer cover provided around periphery of this conductor and made of resin, wherein said portion is placed on the insulating outer cover of the shielded wire and ultrasonic vibration is applied so as to melt and disperse the insulating outer cover of the lead wire together with the insulating outer cover of the shielded wire, bringing the conductor of the lead wire and the braid of the shielded wire conductively in contact with each other.

16. A connecting structure for a shielded wire, comprising:

a shielded wire having a core made of a conductor, a core cover for covering the core, a braid provided around the core cover for shielding, and an insulating outer cover provided around the braid for covering the core, core cover and braid; and a shield terminal having a lead wire attached at an end to a terminal metal and conductively connected at a portion between the attached end and an unattached end to the braid of the shielded wire, wherein said structure is formed by:

placing said portion of the lead wire of the shield terminal on the insulating outer cover of the shielded wire so that said portion crosses the shielded wire;

nipping said crossing portion of the lead wire of the shield terminal on the insulating outer cover of the shield terminal and the shielded wire between a pair of resin chips; and applying an ultrasonic vibration so as to melt and disperse at least the insulating outer cover of the shielded wire, thereby conductively connecting the lead wire and the shielded wire.

* * * * *

UNITED STATES PATENT AND TRADEMARK OFFICE

CERTIFICATE OF CORRECTION

PATENT NO. : 6,218,619 B1
DATED : April 17, 2001
INVENTOR(S) : Nobuyuki Asakura et al.

It is certified that error appears in the above-identified patent and that said Letters Patent is hereby corrected as shown below:

Column 13, claim 9,
Line 46, change "comprising;" to -- comprising: --.
Line 67, claim 10, after "made" insert -- of --.

Column 14, claim 11,
Line 9, change "comprising;" to -- comprising: --.
Line 39, claim 13, change comprising;" to -- comprising: --.

Column 15, claim 15,
Line 2, after "around" insert -- a --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*